US007770300B2

(12) United States Patent
Johnson

(10) Patent No.: US 7,770,300 B2
(45) Date of Patent: Aug. 10, 2010

(54) CHALK LINE

(75) Inventor: Douglas Johnson, Belmont, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 62 days.

(21) Appl. No.: 12/175,135

(22) Filed: Jul. 17, 2008

(65) Prior Publication Data

US 2010/0011599 A1 Jan. 21, 2010

(51) Int. Cl.
*B44D 3/38* (2006.01)

(52) U.S. Cl. ..... 33/414

(58) Field of Classification Search ..... 33/1 LE, 33/413, 414, 756

See application file for complete search history.

(56) References Cited

U.S. PATENT DOCUMENTS 2,749,618 A * 6/1956 Landon ..... 33/414
3,691,639 A * 9/1972 Roeseler et al. ..... 33/414
5,920,997 A * 7/1999 Girtman ..... 33/414
6,079,112 A * 6/2000 Love ..... 33/414
2002/0194744 A1* 12/2002 Shor ..... 33/414
2006/0144985 A1 7/2006 Whitney
2009/0139103 A1* 6/2009 Vary ..... 33/414

OTHER PUBLICATIONS

Stanley Chalk Line from Stanley works Web Catalogue, http://www.stanleyworks.co.uk/Measuring%2c+Levelling+and+Layout/Chalk+Lines/Stanley%c2%ae+Chalk+Line/SkuDetail.ctlg?ObjectID=47-100.
UK Intellectual Property Office, Search Report, Oct. 27, 2009.

* cited by examiner

*Primary Examiner*—G. Bradley Bennett
(74) *Attorney, Agent, or Firm*—Dennis J. Williamson; Moore & Van Allen, PLLC

(57) ABSTRACT

The chalk line comprises a housing that supports the spool having a string or line wound thereon in a chalk chamber. The transmission for rewinding the spool is located in a separate compartment. The chalk filled chamber is isolated from the transmission such that the components located in the chamber are the spool, line and chalk. A door for allowing access to the chamber is opened by manually operating a latch. A safety interlock is also provided such that the latch cannot be inadvertently unlocked.

23 Claims, 6 Drawing Sheets

CHALK LINE

The invention relates to chalk line marking devices commonly referred to as chalk reels, chalk spools, chalk boxes or chalk lines (hereinafter referred to as "chalk lines") and, more particularly, to an easier to repair and maintain chalk line.

BACKGROUND

Chalk lines are known that consist of a spool on which a line or string is wound. The spool, chalk line and the drive transmission for the spool are supported in a housing. The drive transmission may comprise gears, springs and other components that connect the spool to an external handle for rewinding the line on the spool after use. The chamber is filled or partially filled with a colored chalk such that the line that is wound on the spool in the housing is coated in the chalk. The line can be unwound from the housing through an aperture in the housing such that it can be "snapped" on a surface to form a line of chalk on the surface. The resulting line of chalk can be used as a reference line in construction or other applications. The typical chalk line includes an aperture that can be used to refill the chamber with chalk. Typically, the housing consists of housing portions that are assembled with the internal components and secured together by a plurality of screws. The interior of the housing is accessed by removing the screws using a separate tool such as a screw driver and disassembling the housing and components.

An improved chalk line that is easier for a user to repair and maintain is desired.

SUMMARY OF THE INVENTION

The chalk line of the invention comprises a housing that supports the spool having a string or line wound thereon and the chalk in a chalk chamber. The transmission for rewinding the spool and other components are located in a compartment separate from the chalk chamber. The chalk chamber is isolated from the transmission such that the components located in the chalk chamber are the spool, line and chalk. A door or cover for allowing easy access to the chalk chamber is opened by manually operating a latch. A safety interlock is also provided such that the latch cannot be inadvertently unlocked. In another embodiment the door or cover is secured closed by a separate single fastener such as a screw. When the door or cover is opened the internal components of the chalk line other than the spool, line and chalk remain isolated from the chalk chamber and constrained in a separate compartment. A method of operating the chalk line is also disclosed.

DETAILED DESCRIPTION OF PREFERRED EMBODIMENTS OF THE INVENTION

Figure 1:
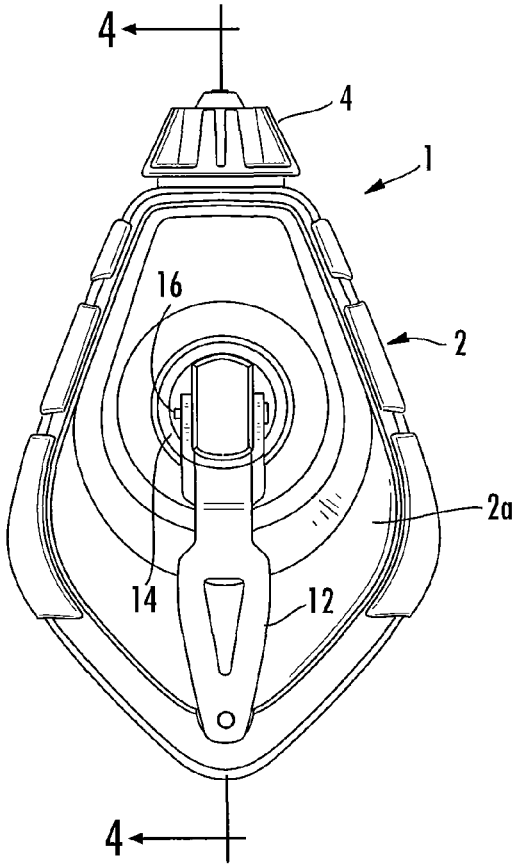
FIG. 1 is a front view of the chalk line of the invention.
Figure 2:
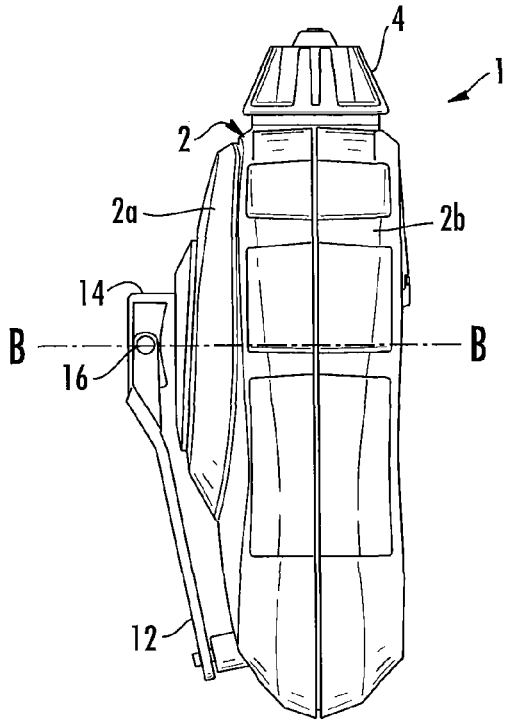
FIG. 2 is a side view of the chalk line of FIG. 1.
Figure 3:
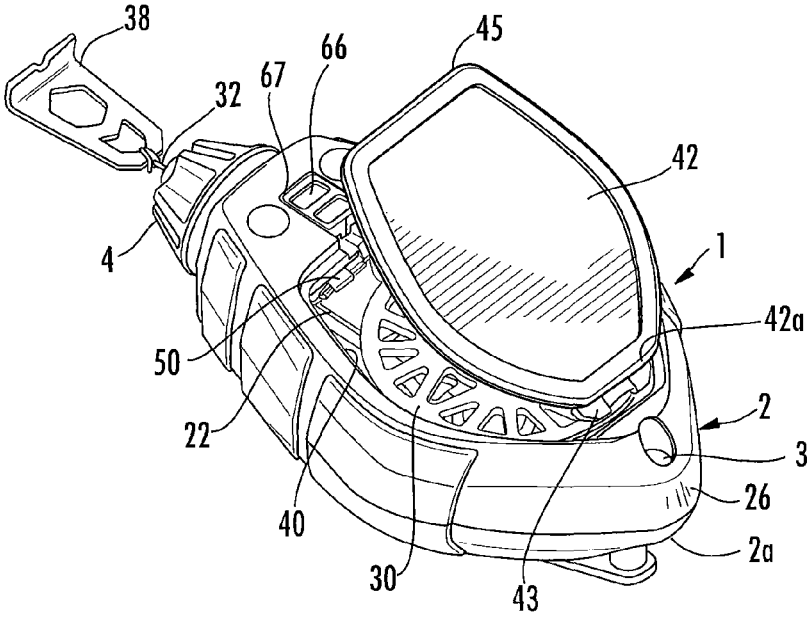
FIG. 3 is a perspective view of the chalk line of FIG. 1.

The chalk line of the invention is shown generally at 1 in the drawings. The chalk line 1 comprises a housing 2 formed of a top portion 2*a* and a bottom portion 2*b*. The top portion 2*a* and bottom portion 2*b* are connected together by fasteners 3 such as threaded screws. The top portion 2*a* and bottom portion 2*b* may also be secured together by adhesive, welding, a mechanical snap fit or the like.

The top portion 2*a* and bottom portion 2*b* trap a fill cap 4 therebetween such that the cap 4 can rotate relative to the housing 2. The fill cap 4 fits in a mating aperture 5 in the housing 2. A rubber gasket 7 is disposed between the housing 2 and the bottom of the cap 4. The engagement of the cap 4 with the housing 2 creates a seal between these elements to prevent chalk from escaping from housing 2.

The spool drive mechanism 11 comprises a rewind handle 12 that is mounted for rotary motion to the outside of housing 2. The handle 12 is connected to rotary member 14 at pivot 16 such that the handle can be pivoted from the locked position shown in the figures to an extended position where handle 12 can be used to rotate member 14 about axis B-B. Rotary member 14 is connected to output shaft 16 via a transmission 18. When the handle 12 is rotated in a first direction the output shaft 16 is rotated via transmission 18 to rewind the string or line 32 into the housing 2 and onto spool 30. When the line or string 32 is pulled from the housing during use and unwound from spool 30, the output shaft 16 is rotated in the opposite direction. The rotation of shaft 16 during unwinding of the string or line 32 may be transmitted to the handle 12 or rotating member 14 can be depressed to act as a clutch and thereby disengage the transmission 18 from rotating member 14 such that the handle does not rotate as the string or line 32 is extended. Spring 17 returns the rotating member 14 to the engaged position when the user releases member 14. Transmission 18 is located in a compartment 24 that it is isolated from chalk chamber 22 by wall 20 such that the only portion of the spool drive mechanism located in the chalk chamber is the portion of output shaft 16 that extends through aperture 21 in wall 20. A felt seal 19 is disposed between reel 30 and wall 20 that prevents the chalk in chamber 22 from entering compartment 24. By isolating the spool drive mechanism 11 from the chalk chamber 22, a user can access the chalk chamber 22 without exposing the spool drive mechanism. As a result, the risk of fouling, breaking or inadvertently disassembling the spool drive mechanism is minimized.

Spool 30 is located in the chalk chamber 22 such that it is engaged by and rotates with the output shaft 16. In the illustrated embodiment the output shaft 16 has a rectangular cross section that engages a similarly shaped aperture on spool 30 such that the spool 30 and shaft 16 rotate together. The spool 30 slides onto shaft 16 such that it is removably mounted on the shaft and can be removed from the chalk chamber 22 when a user accesses the chalk chamber. The only components that are removable from chalk chamber 22 are the spool 30 with line 32 wound thereon and the chalk. Line or string 32 is wound on the spool and extends from housing 2 through an aperture 36 in cap 4. An end hook 38 may be attached to the string or line 32 to allow the line or string to be temporarily attached to a structure during use. When the line or string 32 is extended from the housing, the spool 30 rotates in a first direction to unwind the string or line 32. When the spool 30 is rotated in a second direction opposite to the first direction by handle 12, the line or string is wound back onto the spool 30.

The chalk chamber 22 is accessed via an opening 40 in housing 2. The inventors of the present invention identified that a problem with chalk line devices is that chalk has the tendency to stick together or "cake" inside of the chalk spool and that access to the chalk chamber is problematic especially at the work site. The caked chalk can be caused by a variety of reasons but is usually related to moisture, dew, humidity and wet working conditions. The fouled chalk can prevent the proper operation of the chalk line. The caked chalk may also prevent rotation of spool 30 and can cause breakage of the transmission 18 or handle 12. Opening 40 is dimensioned such that the spool 30 can fit through the opening and be removed from chamber 22.

Allowing quick, easy access to the chalk chamber 22 allows a user to clean out the chalk chamber and break up sticky, caked chalk. However, in traditional chalk lines access is provided by disassembling the housing and internal components by unscrewing separate fasteners using a tool such as a screwdriver. In known prior art devices the user must have the appropriate tool available. It can also be time consuming to remove and reinstall the fasteners. Further, in a work environment it is possible to misplace the fasteners. While in traditional chalk spools the chamber in which the transmission and other components are located is isolated from the chalk chamber in the assembled device, when the fasteners are removed and the housing is disassembled to access the chalk, line and spool, other components of the chalk line are also exposed and unconstrained. As a result, these components can become fouled with chalk and can be lost or damaged during cleaning of the chalk chamber. These components must also be reassembled.

In the chalk reel 1, the opening 40 is closed by a door or cover 42. In the chalk reel of the invention, the door can be opened easily and when opened the only components that may be removed from the chalk chamber are the spool 30 and the line 32. The other components, such as transmission 18, rotating member 14, spring 17 and other components such as locks and the like, remain isolated from the chalk chamber and remain constrained in place within compartment 24.

The door 42 is dimensioned to fit against opening 40 to seal the chalk in the chamber 22. A pliable gasket 45 may be provided about the periphery of the door 42 to seal the opening. Door 42 is hinged at a first end 42*a* in the opening 40. In the illustrated embodiment the door 42 includes a flange 43 that is inserted under the edge of the opening 40 to allow the door to pivot about the engagement of the flange 43 with the edge of the opening 40. With such an arrangement the door is also completely removable from housing 2. Alternatively, a mechanical pin hinge or a strap hinge or the like may be used. The door 42 also includes a structure for mating with latch 60 to lock the door in the closed position. In the illustrated embodiment a cavity 46 is formed on the bottom of the door 42 into which the latch is inserted. The door 42 may also include a bearing surface 48 that engages the rotational axis of the spool 30 to support and stabilize the spool as it rotates in the housing 2.

A spring may be used that is biased to open the door 42 slightly when the latch is opened. In the illustrated embodiment, a pair of leaf springs 50 are mounted on the housing so as to extend into the opening 40 adjacent the latch. The leaf springs 50 extend into the opening 40 and engage the bottom of the door 42 when the door is closed. In this position the leaf springs 50 are deformed and store energy. When the latch 60 is released, the leaf springs 50 return to their undeformed condition forcing the door 42 open. Other spring-type mechanisms for opening the door may also be used.

Figure 4:
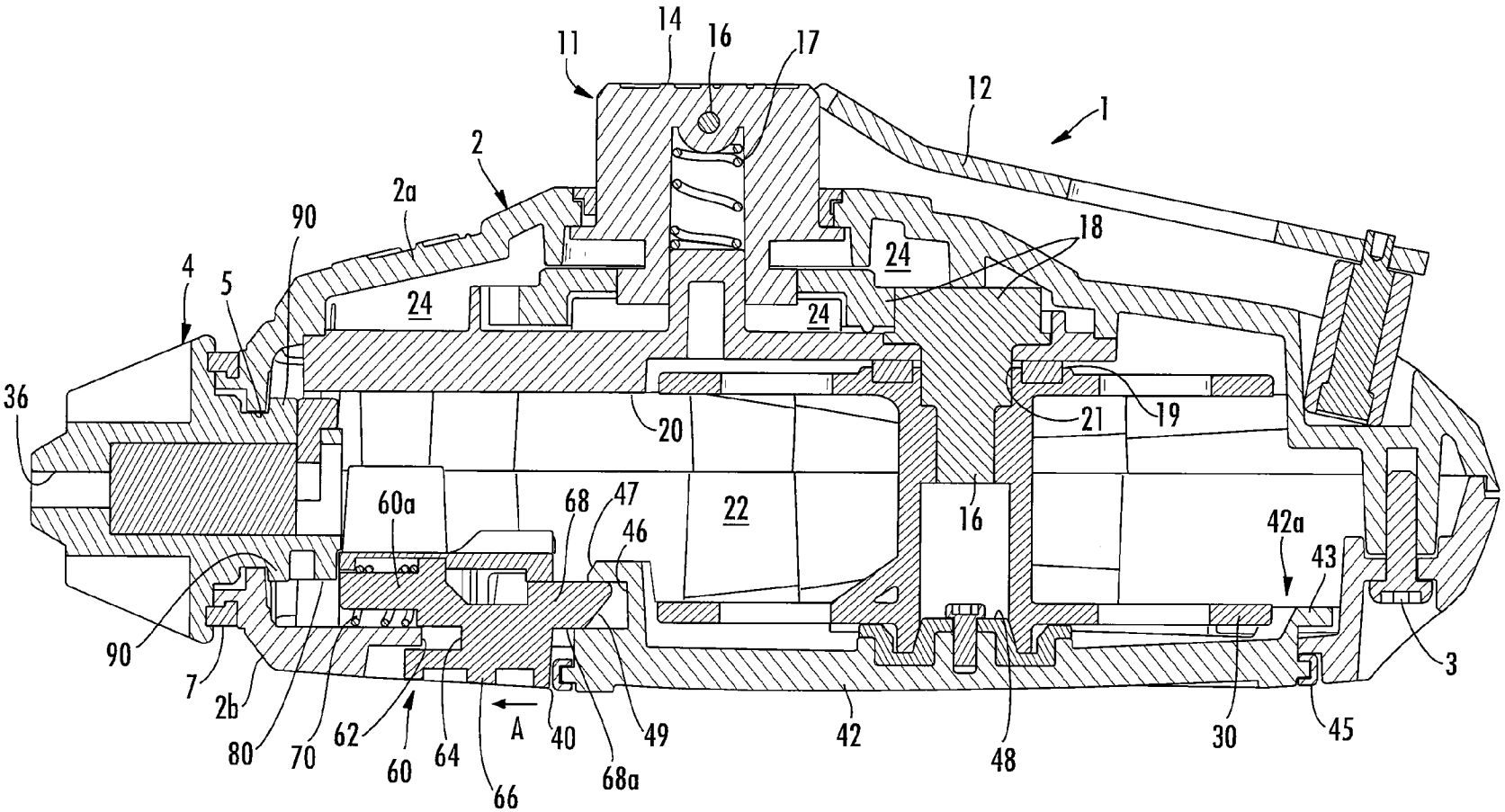
FIG. 4 is a section view taken along line A-A of FIG. 1 with the safety interlock engaged.
Figure 5:
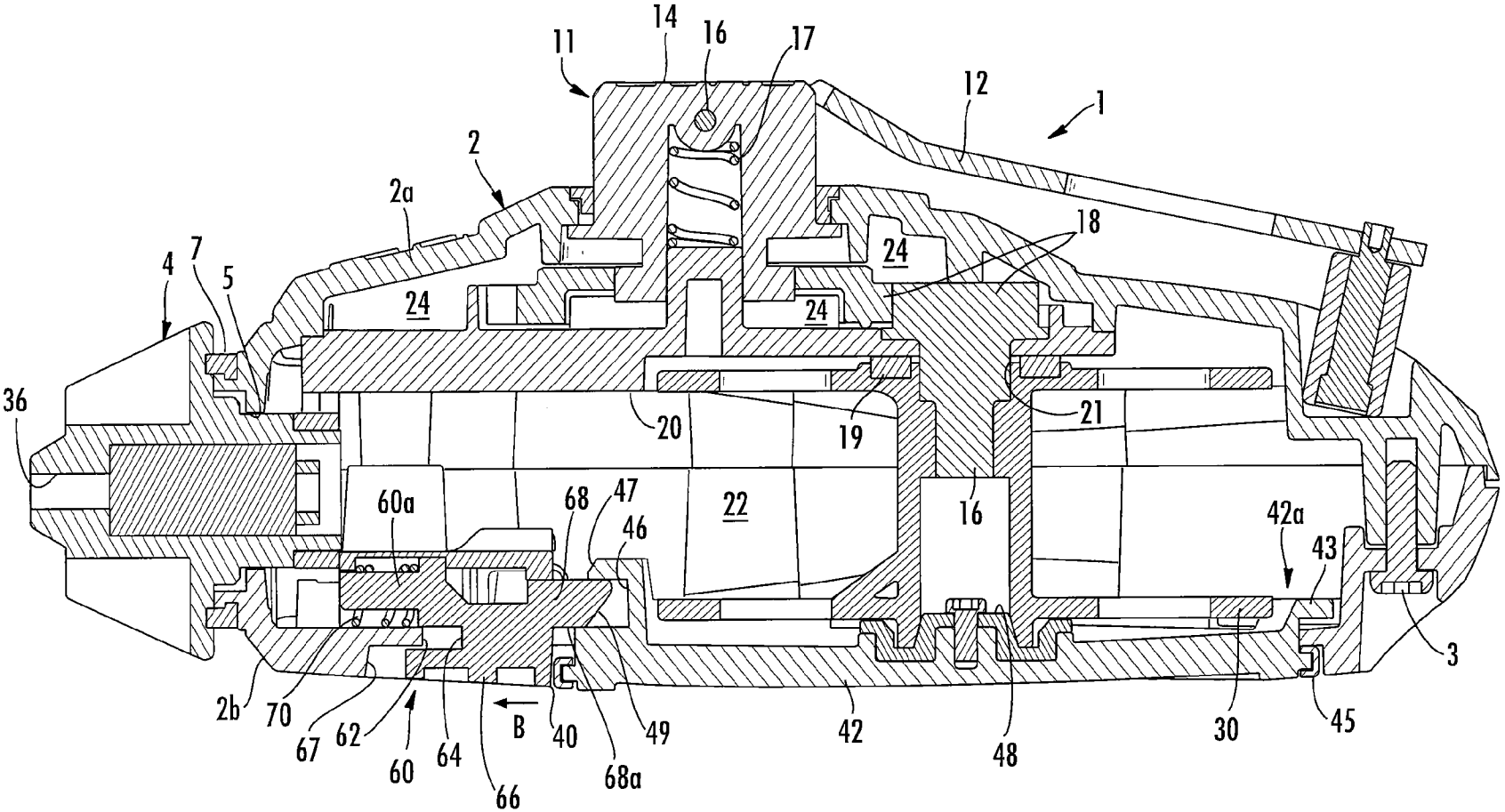
FIG. 5 is a section view similar to that of FIG. 4 with the safety interlock disengaged.

The latch 60 is slidably supported on housing 2 so as to reciprocate relative to the housing 2 between a locked and unlocked position. In the illustrated embodiment, the latch 60 is held in a slot 62 formed in housing 2 such that it can reciprocate along the housing. The latch 60 includes a narrow neck portion 64 that is slidably received in the slot 62 and connects a wider top member 66 to a wider bottom member 68 that retain the sliding member 60 on the housing 2. The top member 66 is formed as a button that is located in a recess 67 in the housing 2 and that is manipulated by the user to move the latch 60 between the locked and unlocked positions. The bottom member 68 is formed as a latch bolt 68*a* that engages the door 42 in the locked position. The latch bolt 68*a* may be formed as a wedge that engages cavity 46. A spring 70 biases the latch 60 to the locked position in the direction of arrow A as shown in FIG. 5. The spring 70 may be a compression coil spring that is compressed between the latch 60 and a housing wall. As shown in FIG. 4 the latch 60 may include a projection 60*a* that engages spring 70 to maintain the relative orientation between the spring and the latch 60. The latch 60 can be moved against spring 70 (opposite the direction of arrow A) from the locked position of FIG. 4, where the latch bolt 68*a* engages the door 42 and prevents it from opening to an unlocked position where the latch bolt 68*a* does not engage door 42 and the door can be opened and chamber 20 accessed. The user pushes on member 66 to move the latch 60 in the direction opposite arrow A.

The door 42 can be closed by a user without manipulating the latch. Door 42 is formed with a camming surface 47 that engages a cooperating camming surface 49 formed on latch 60 such that when the door is shut the camming surfaces engage one another. The surfaces 47 and 49 are arranged such that as the door is closed the surfaces slide over one another and latch 60 is pushed in the direction of arrow A. When the door 42 is shut, spring 70 forces latch 60 to the engaged and locked position shown in FIG. 4.

Because chamber 22 is filled with chalk, the inadvertent opening of the door 42 could create a chalk spill and/or the loss of the spool 30. To prevent the inadvertent opening of the door 42, a safety mechanism is provided. The safety mechanism comprises the rotating fill cap 4 that must be properly positioned to allow the latch 60 to move to the unlocked position. The fill cap 4 includes a flange 80 that engages the end of the latch 60 as best shown in FIG. 4. The flange 80 abuts the projection 60*a* when the cap 4 is in the first locked or safety position. In this position of the cap 4, the abutting engagement of latch 60 with the flange 80 prevents the latch 60 from being moved to the open unlatched position (in the direction of arrow B, FIG. 5). To open the door 42 the cap 4 is rotated about the axis of aperture 36. The cap 4 is rotated until the flange 80 is rotated away from latch 60 as shown in FIG. 5. In this position the latch 60 can move to the unlocked position.

To open door 42, the safety mechanism is moved to the safety off position where the cap 4 is first rotated from the position shown in FIG. 4 to the position of FIG. 5 where the cap 4 does not interfere with the movement of latch 60 (block 1001). The latch 60 is then moved to the unlocked position as shown at arrow B in FIG. 5 (block 1002). When the latch 60 clears the door 42, the springs 50 push open the door (block 1003). The user can then access the spool 30, line or string 32, shaft 16 and the chalk that are located in chamber 22 (block 1004). The spool 30, line or string 32 and the chalk can be removed from the housing. The rest of the internal components remain isolated from the user and constrained in compartment 24 (block 1005).

Figure 6:
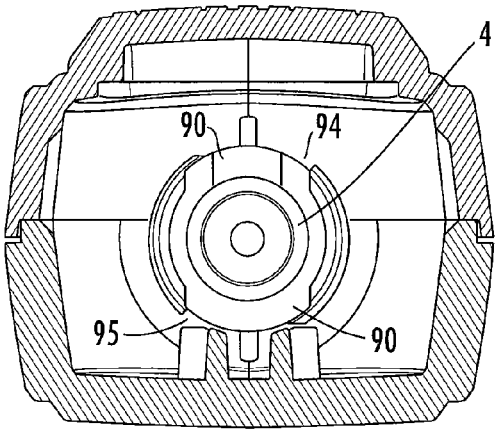
FIGS. 6, 7 and 8 are section views showing the attachment of the fill cap to the housing of the chalk line of FIG. 1.
Figure 7:
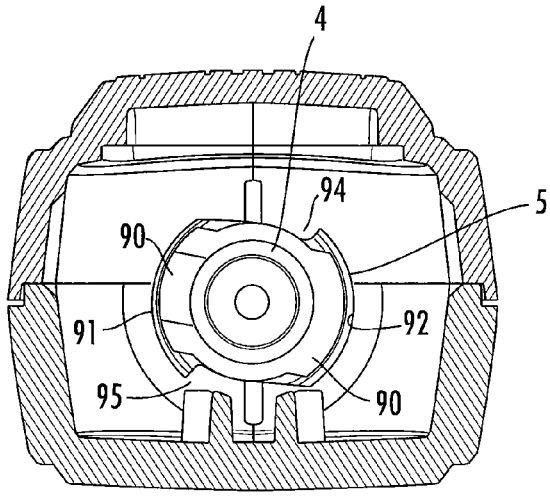
Figure 8:
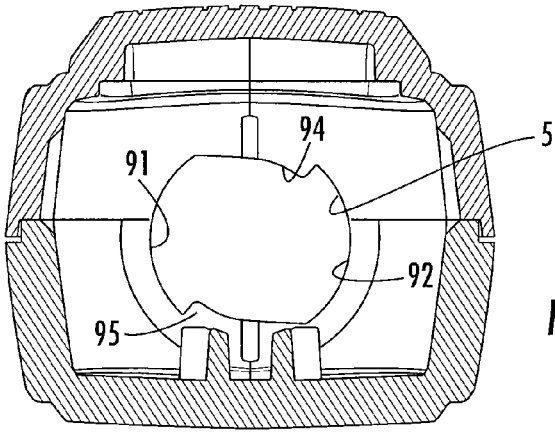

FIGS. 6, 7 and 8, the cap 4 has a pair of flanges 90 that engage the back side of the aperture 5 formed in the housing 2. Flanges 90 cooperate to retain the cap 4 in the housing. Aperture 5 is formed with an irregular shape where opposed side walls 91 and 92 are spaced a distance that allows the flanges 90 to pass through aperture 5 and opposed side walls 94 and 95 are spaced a distance that prevents the flanges 90 from passing through aperture 5. When cap 4 is in the position of FIG. 6 flanges 90 engage the side walls 94 and 95 to retain the cap 4 on the housing 2. When the cap 4 is rotated to the position of FIG. 7, the flanges 90 are rotated away from side walls 94 and 95 and are aligned with side walls 91 and 92. Because side walls 91 and 92 are spaced apart farther than the width of cap 4, the flanges 90 do not engage housing 2. In this position the cap 4 can pass through aperture 5 and be completely removed from the housing 2. The opening 5 can then be used to refill the chamber 22 with chalk.

Figure 9:
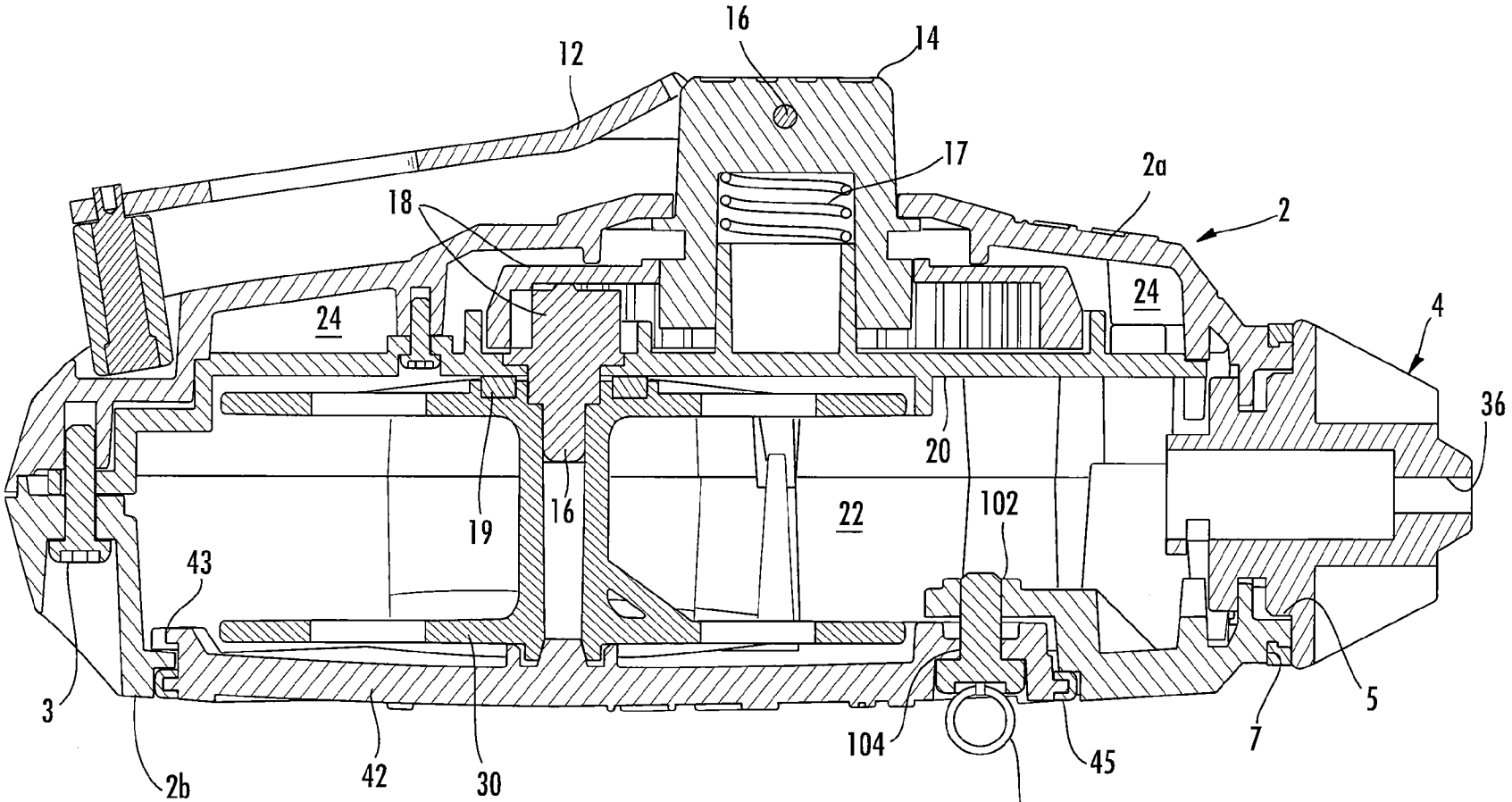
FIG. 9 is a section view of another embodiment of the chalk line of the invention showing the access door secured with a single fastener.
Figure 10:
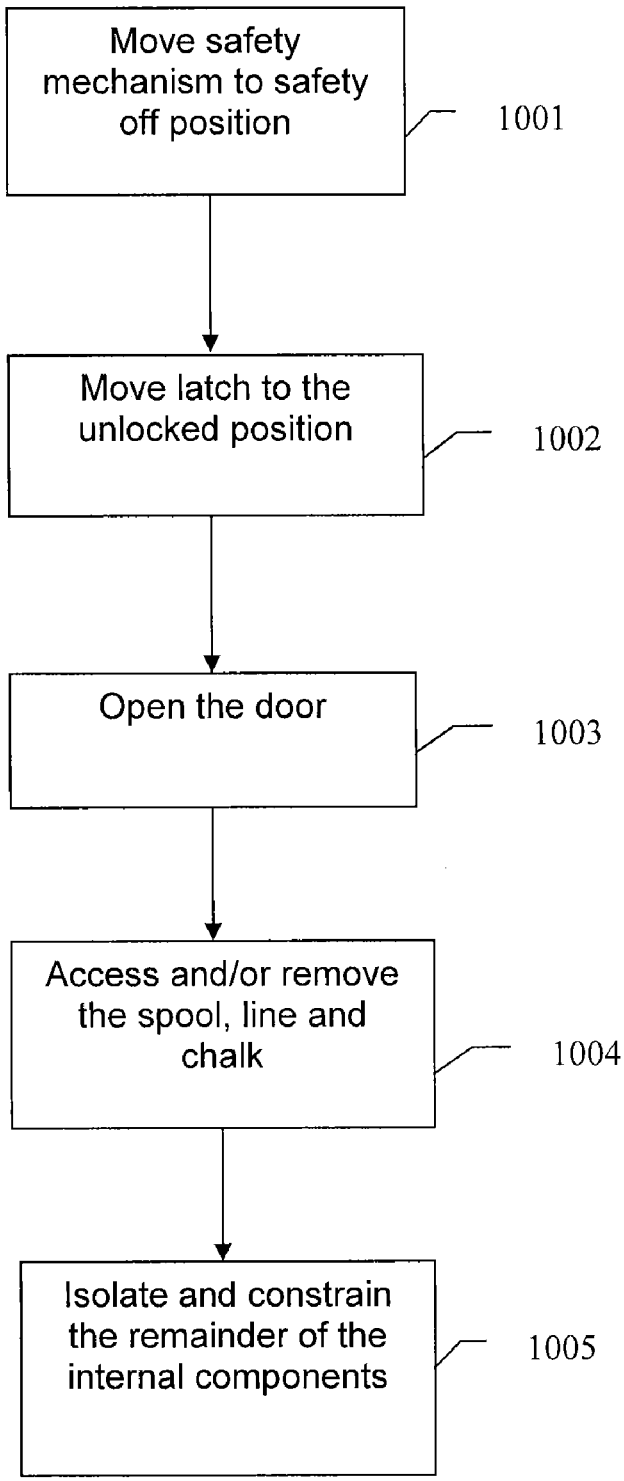
FIG. 10 is a block diagram illustrating an operation of the chalk line of the invention.

Referring to FIG. 9, another embodiment of the invention is disclosed where like reference numerals are used to refer to the same components described with respect to FIGS. 1 through 8. In the embodiment of FIG. 9 a single fastener 100 such as a threaded screw is mounted on door 42. Fastener 100 may also include a tooless type of fastener such as a thumb screw or wing nut such that the fastener can be unfastened without a tool. Fastener 100 engages a mating threaded bore 102 formed on the housing 2 to secure the door in the closed and locked position. The door is opened by unscrewing fastener 100 from bore 102. The screw 100 remains captured in the door even in the unfastened state such as by engagement with recess 104 or by use of a lock washer (not shown) such that it cannot be lost by the end user. In this embodiment the only components accessible and removable from the chalk chamber are spool 30, line 32 and the chalk. Shaft 16 is accessible but not removable. The other components remain constrained in chamber 24 and are isolated from chalk in chamber 22.

While embodiments of the invention are disclosed herein, various changes and modifications can be made without departing from the spirit and scope of the invention as set forth in the claims. One of ordinary skill in the art will recognize that the invention has other applications in other environments. Many embodiments are possible.

The invention claimed is:

1. A chalk line comprising:

a housing defining a chalk chamber and an opening for accessing said chamber;

a door movable between an open position for allowing access through said opening to the chalk chamber and a closed position preventing access to said chamber; and a latch movable between a locked position in which said door is maintained in the closed position and an unlocked position in which said door can move to said open position.

2. The chalk line of claim 1 further including a safety device for preventing said latch from moving to said unlocked position.

3. The chalk line of claim 2 wherein said safety device selectively abuts said latch.

4. The chalk of line claim 2 wherein the safety device comprises a fill cap, said fill cap can be removed from said housing to allow access to the chalk chamber.

5. The chalk line of claim 3 wherein said safety device comprises a member that is moved into abutting relationship with said latch.

6. The chalk line of claim 1 wherein said latch is biased to said locked position.

7. The chalk line of claim 1 further including a spring for biasing said door to the open position.

8. The chalk line of claim 1 wherein said latch slides relative to said housing to engage the door.

9. The chalk line of claim 1 further including a spool in said chalk housing.

10. The chalk line of claim 1 wherein said drive mechanism for said spool is isolated from said chalk chamber.

11. The chalk line of claim 9 wherein a chalk line is wound on said spool.

12. The chalk line of claim 4 wherein a chalk line is wound on said spool and said chalk line extends through said fill cap.

13. The chalk line of claim 9 wherein said door includes a bearing member for rotatably supporting a spool.

14. The chalk line of claim 1 wherein said door is completely removable from said housing.

15. A chalk line comprising:

a housing defining a chalk chamber and an opening for accessing said chamber;

a door movable between an open position for allowing access through said opening to the chalk chamber and a closed position preventing access to said chamber; and a latch movable between a locked position in which said door is maintained in the closed position and an unlocked position in which said door can move to said open position;

a safety device that selectively intersects movement of said latch for preventing said latch from moving to said unlocked position.

16. A method of operating a chalk line, comprising:

providing a housing defining a chalk chamber and an opening for accessing said chamber and a door movable between an open position for allowing access through said opening to the chalk chamber and a closed position preventing access to said chamber, and a latch for locking and unlocking the door;

moving a safety mechanism from a first position where the latch is prevented from moving to a second position where the latch can move;

moving the latch between a locked position in which said door is maintained in the closed position to an unlocked position where said door can move to said open position.

17. A chalk line comprising:

a chalk chamber;

a door for opening and closing an access opening to said chalk chamber;

a spool supporting a chalk line in said chalk chamber, and a latch, which is capable of sliding, which has a latch bolt for engaging the door, a section of the latch being exposed to the exterior of the main body;

a safety member, which interferes with the latch and thereby blocks the operation of the latch bolt, said safety member being capable of moving in a direction, that intersects with the direction along which the latch moves, and a biasing member, which biases said latch to a locking direction.

18. A chalk line device comprising:

a housing defining a compartment for retaining components of the chalk line device and a chalk chamber retaining a spool and an opening for accessing said chamber, said opening being dimensioned such that said spool can fit through said opening;

a door movable between an open position for allowing access through said opening to the chalk chamber and a closed position preventing access to said chamber where said components remain isolated from the chalk chamber when said door is in the open position.

19. The chalk line device of claim 18 wherein said spool may be removed from said chalk chamber through said opening.

20. A chalk line comprising:

a housing defining a chalk chamber and an opening for accessing said chamber;

a door movable between an open position for allowing access through said opening to the chalk chamber and a closed position preventing access to said chamber;

a latch movable between a locked position in which said door is maintained in the closed position and an unlocked position in which said door can move to said open position;

a safety device comprising a fill cap for preventing said latch from moving to said unlocked position.

21. A chalk line device comprising:

a housing defining a chalk chamber and a first opening for accessing said chamber and a second opening for accessing said chamber;

a door movable between an open position for allowing access through said first opening to the chalk chamber and a closed position preventing access to said chamber through said first opening;

a fill cap removable from said second opening allowing access through said second opening.

22. The chalk line device of claim 21 wherein a chalk line is wound on a spool in said chamber and said chalk line extends through said fill cap.

23. A chalk line device comprising:

a housing defining a chalk chamber retaining a spool and an opening for accessing said chamber, said opening being dimensioned to allow said spool to be removed from said chalk chamber through said opening;

a door movable between an open position for allowing access through said first opening to the chalk chamber and a closed position preventing access to said chamber through said first opening;

a fastener for securing said door in said closed position.

* * * * *